US006716492B1

(12) United States Patent
Moriya et al.

(10) Patent No.: US 6,716,492 B1
(45) Date of Patent: Apr. 6, 2004

(54) RECORDING MEDIUM FOR INK-JET RECORDING

(75) Inventors: Kenichi Moriya, Urayasu (JP); Mamoru Sakaki, Yamato (JP); Masato Katayama, Yokohama (JP); Michio Araki, Yokohama (JP); Satoshi Kojima, Ibaraki-ken (JP)

(73) Assignees: Canon Kabushiki Kaisha, Tokyo (JP); Oji Paper Co., Ltd., Tokyo (JP); Nihon Punch Card Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/583,981

(22) Filed: May 31, 2000

(30) Foreign Application Priority Data

Jun. 2, 1999 (JP) ..... 11-155719

(51) Int. Cl.[7] ..... B41M 5/00
(52) U.S. Cl. ..... 428/32.1; 428/32.18; 428/43
(58) Field of Search ..... 428/43, 167, 155, 428/192, 57, 195, 32.1, 32.18; 503/227

(56) References Cited

U.S. PATENT DOCUMENTS

| | | | | | |
|---|---|---|---|---|---|
| 4,664,952 | A | | 5/1987 | Arai et al. | 427/256 |
| 4,686,118 | A | | 8/1987 | Arai et al. | 427/261 |
| 5,393,727 | A | * | 2/1995 | Egashira et al. | 503/227 |
| 5,585,193 | A | * | 12/1996 | Josephy et al. | 428/515 |
| 5,733,637 | A | | 3/1998 | Moriya et al. | 428/207 |
| 5,789,050 | A | * | 8/1998 | Kang | 428/42.3 |
| 5,853,837 | A | | 12/1998 | Popat | 428/43 |
| 6,153,557 | A | * | 11/2000 | Nakanishi | 503/201 |
| 6,284,708 | B1 | * | 9/2001 | Oshima et al. | 503/227 |
| 2001/0036525 | A1 | * | 11/2001 | Yokokawa | 428/43 |

FOREIGN PATENT DOCUMENTS

| | | | | |
|---|---|---|---|---|
| DE | 94 14 959 U1 | | 12/1994 | |
| DE | 92 19 168 U1 | | 1/1999 | |
| JP | 10-166748 | | 6/1998 | |
| JP | 2001205936 A | * | 1/2000 | B41J/2/01 |

* cited by examiner

*Primary Examiner*—B. Hamilton Hess
(74) *Attorney, Agent, or Firm*—Fitzpatrick, Cella, Harper & Scinto

(57) ABSTRACT

Disclosed herein is a recording medium for ink-jet recording, which comprises at least one first half-cut line formed in a machine direction (MD) and at least one second half-cut line perpendicular to the MD direction, wherein the half-cut lines are in the form of a series of perforations with a cut portion and an uncut portion alternately arranged continuously, and the length of the uncut portion in the first half-cut line is longer than the length of the uncut portion in the second half-cut line.

5 Claims, 2 Drawing Sheets

RECORDING MEDIUM FOR INK-JET RECORDING

BACKGROUND OF THE INVENTION

1. Field of the Invention

The present invention relates to a recording medium suitably used in ink-jet recording.

2. Related Background Art

Most of the ink-jet printers widely spread at present inevitably produce non-printed regions at the leading edge, left and right sides and trailing edge of a recording medium for ink-jet recording (hereinafter referred to as "recording medium" simply) fed therein. These non-printed regions are regions required to stably convey the recording medium in a printer or to prevent the interior of the printer from being stained with an ink and unavoidably caused at present.

In addition, the widths of the non-printed regions at the leading edge and trailing edge of the recording medium cannot be made equal to each other, which depends on the type of a printer. If the-widths of both regions are made equal, extremely wide non-printed regions are left. For example, in the case where a non-printed region of a fixed width unavoidably occurs at a trailing edge of a recording medium, a wide non-printed region is left at a part of the recording medium. In a printer of a general structure, the width of the non-printed region unavoidably caused is about 10 to 20 mm. A printed region of a print deviates from the center of the recording medium due to the non-printed region, and thus the beautiful appearance, design and added value of the print are lowered. When a non-printed region caused at the leading edge is matched to a non-printed region caused at the trailing edge thereof, the printed region can be located at the center of the printing medium. However, unusual wide non-printed regions are formed at the leading and trailing edges of the medium, and so the beautiful appearance, design and added value of the print are lowered.

Japanese Patent Application Laid-Open No. 10-166748 has proposed a recording medium by which non-printed regions can be freely preset by using a half-cut line to separate the recording medium into at least two pieces, and all non-printed region may be removed according to circumstances.

The recording medium disclosed in Japanese Patent Application Laid-Open No. 10-166748 can be easily separated into at least two pieces, but involves a problems that it is far from being satisfactory from the viewpoints of ease of separation and fineness of the separated portions.

SUMMARY OF THE INVENTION

It is an object of the present invention to provide a recording medium which can solve the above-described problems involved in the prior art and can achieve stable conveyability without causing a failure in conveying such as bending of a series of perforations which form a half-cut line to separate the recording medium into two or more pieces, or breaking of the perforations during conveyance of the recording medium in a printer.

The above object can be achieved by the present invention described below.

According to the present invention, there is thus provided a recording medium for ink-jet recording, which is provided with at least one half-cut line (2) (hereinafter referred to as "cut line" simply) formed in a machine direction (MD) and at least one half-cut line (3) perpendicular to the MD direction, wherein the half-cut lines are in the form of a series of perforations with a cut portion and an uncut portion alternately arranged continuously, and the length (β) of the uncut portion in the half-cut line (2) is longer than the length (β') of the uncut portion in the half-cut line (b).

DESCRIPTION OF THE PREFERRED EMBODIMENTS

Figure 1:
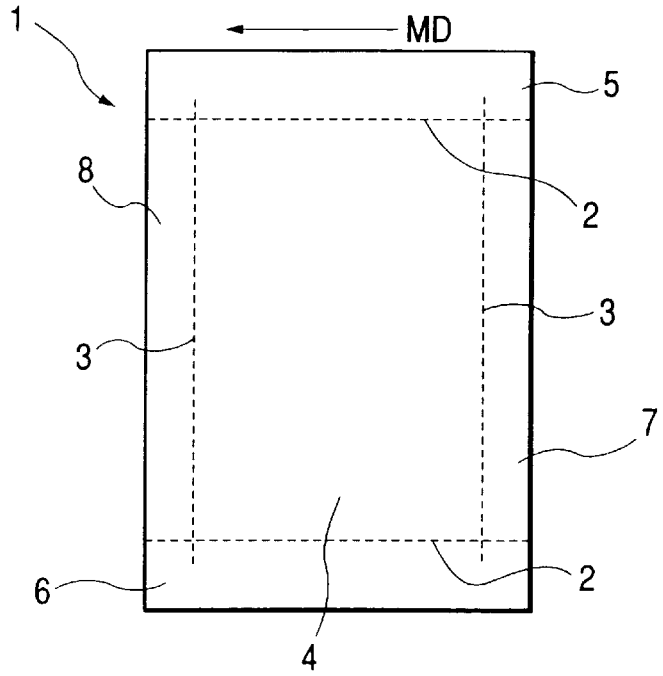
FIG. 1 illustrates the construction of a recording medium according to the present invention.
Figure 2:
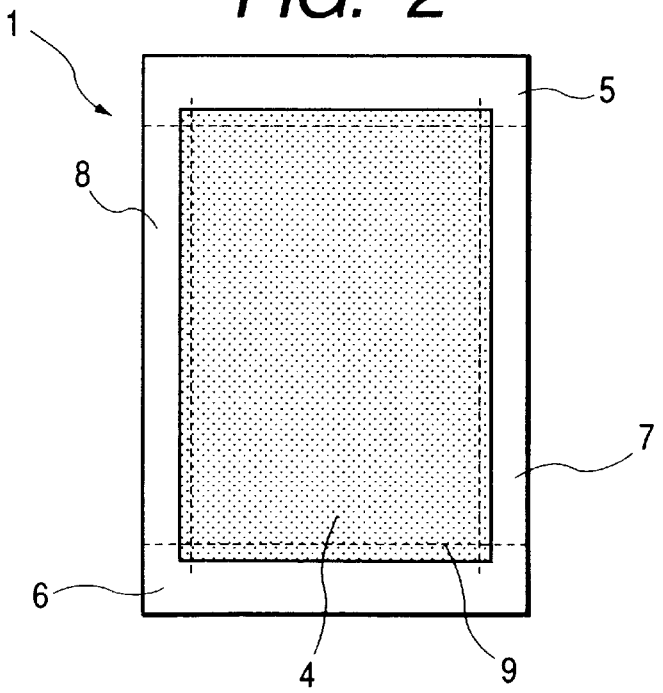
FIG. 2 illustrates a condition that an image has been formed on the recording medium shown in FIG. 1.
Figure 3:
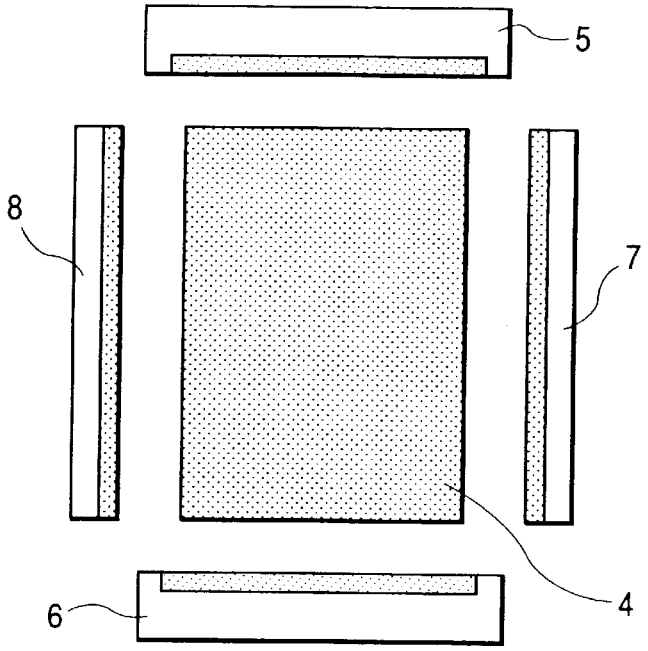
FIG. 3 illustrates a condition that peripheral parts of the recording medium shown in FIG. 2 have been cut off.

The present invention will hereinafter be described in more detail by the preferred embodiments illustrated. FIGS. 1, 2 and 3 illustrate a recording medium according to a preferred embodiment of the present invention. Incidentally, the term "MD direction" used in the present invention means a machine direction of paper.

Figure 4:
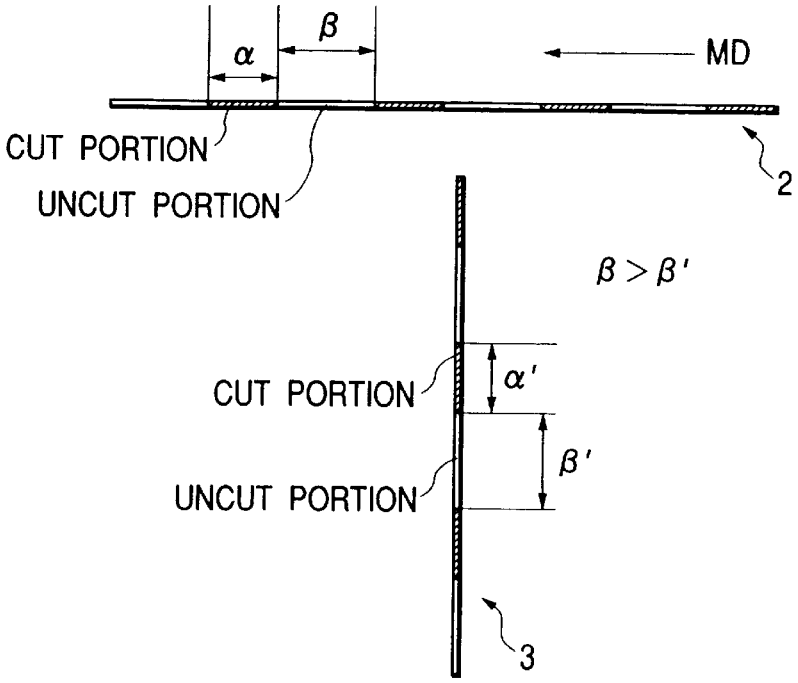
FIG. 4 illustrates a relationship between uncut portions and cut portions in a cut line.

In FIG. 1, the recording medium 1 is provided with cut lines 2 and 3. These cut lines 2 and 3 are in the form of a series of perforations in which cut portions (α, α') and uncut portions (β, β') are alternately continuously arranged as illustrated in FIG. 4, along which the recording medium 1 can be easily separated. With this recording medium, an image-forming portion 4 can be easily separated from cutting-off portions 5 to 8. The phrase "can be easily separated" used in the present invention means that separation can be easily conducted by only hands without using any device.

The cut lines 2 and 3 in the recording medium according to the present invention are characterized in that they are in the form of a series of perforations in which cut portions α, α' and uncut portions β, β' are alternately continuously formed in the form of a dotted line as illustrated in FIG. 4, and that when the cut lines 2 are parallel to the MD direction and the cut lines 3 are perpendicular to the MD direction, the length of an uncut portion β' in the cut line 3 is different from the length of an uncut portion β in the cut line 2, namely, the length of the uncut portion β in the cut line 2 is longer than the length of the uncut portion β' in the cut line 3. As described above, the length of the uncut portion β' in the cut line 3 perpendicular to the MD direction is made shorter in view of the influence of orientation of pulp fibers making up a base material of the recording medium, whereby the ease of separation when the recording medium is separated along the cut lines 2 and 3 can be equalized, and the separated portions after the separation can be formed in a fine straight line.

In the present invention, the term "cut portion α or α'" in the cut line means a notched (perforated) portion, while the term "uncut portion β or β'" means a unnotched (unperforated) portion. The term "a ratio of the cut portion α or α' to the uncut portion β or β'" as used in the present invention denotes a ratio between the length of "cut portion α or α' " and that of "uncut portion β or β'".

The cut portion may be either a hole (through-hole) extending through the whole thickness of the recording medium or a notch not extending through the whole thickness of the recording medium. However, the through-hole is preferred from the viewpoint of ease of separation.

When the length of the uncut portion β in the cut line 2 parallel to the MD direction of the recording medium is equal to the length of the uncut portion β' in the cut line 3 perpendicular to the MD direction, the cut lines are affected by the orientation of pulp fibers making up the base material to cause trouble with the cut line of any side. For example, when the length of the uncut portion β in the cut line 2 parallel to the MD direction, which is optimized from the viewpoints of ease of separation at the end, fineness of the separated portion and good conveyability, is made equal to the length of the uncut portion β' in the cut line 3 perpendicular to the MD direction, burrs and fuzzes (mark of the uncut portions in the series of perforations) are left when the recording medium is separated along the cut line perpendicular to the MD direction, since the direction perpendicular to the MD direction is perpendicular to the orientation of the pulp fibers making up the base material in contrast to the direction parallel to the MD direction, so that the separated portion becomes messy in appearance, resulting in a failure to provide a highly value-added print.

On the other hand, when the length of the uncut portion β' in the cut line 3 perpendicular to the MD direction, which is optimized from the viewpoints of ease of separation at the end, fineness of the separated portion and good conveyability, is made equal to the length of the uncut portion β in the cut line 2 parallel to the MD direction, the cut line parallel to the MD direction becomes very easy to break. This is because the direction parallel to the MD direction is parallel to the orientation of the pulp fibers making up the base material, in contrast to the direction perpendicular to the MD direction. As a result, there is caused such a problem that the recording medium is separated along the cut line during the production of the recording medium, so that the yield thereof cannot be increased; or that the recording medium is separated along the cut line during its conveyance in a printer, so that an intended normal image cannot be formed or the recording medium causes paper jam to destroy the printer.

The length of the uncut portions β, β' in the cut line is preferably within the range of from 0.18 mm to 0.25 mm. If the length of the uncut portions β,β' is too short, the resulting recording medium is very easy to be separated along such a cut line, and so the yield of the recording medium may not be increased in some cases. Besides, such a recording medium may cause such a problem that recording medium is separated along the cut line during its conveyance in a printer, and so an intended normal image cannot be printed, or the recording medium causes paper jam to destroy the printer. If the uncut portion is too long on the other hand, burrs and fuzzes (mark of the uncut portions in the cut line) may be left in some cases when the recording medium is separated along the cut line.

The ratio of the cut portion to the uncut portion is preferably within the range of from 1.3 to 1.7. If the ratio of the cut portion to the uncut portion is too low, burrs and fuzzes (mark of the uncut portions in the series of perforations) may be left in some cases. If the ratio of the cut portion to the uncut portion is too high, the resulting recording medium is very easy to be separated along such a cut line, and so the yield of the recording medium may not be increased in some cases. Besides, such a recording medium may cause such a problem that recording medium is separated along the cut line during its conveyance in a printer, and so an intended normal image cannot be printed, or the recording medium causes paper jam to destroy the printer. The cut lines 2 and 3 are preferably formed by a micro-sewing machine by which burrs are hard to occur at separated portions after the resulting recording medium is separated along the cut lines. A forming method itself may be any conventionally-known method.

The recording medium of the above-described construction according to the present invention is fed to an ink-jet printer in the same manner as in the ordinary recording media. The cutting-off portions 5 and 6 of the recording medium 1 are preferably of the same sizes so as to correspond to wide non-printed regions unavoidably caused and to make it unnecessary to distinguish between top and bottom in the recording medium upon printing in consideration of the width of the above-described non-printed regions. Since the cutting-off portions 5 to 8 are portions to be cut off later, a color, a pattern, notes and/or the like may be printed thereon to give advice so as to take a right feeding direction to a printer. As described above, the cutting-off portions 5 to 8 will be cut off later, and so the printing of the color, pattern and notes do not affect a final print at all.

FIG. 2 illustrates a condition that printing has been conducted so as not to cause a blank in the image-forming portion 4. In this embodiment, printing is conducted on a printing region 9 including the circumferences of the cut lines 2 and 3 of the recording medium 1. The widths of the circumferences of the cut lines 2 and 3 may be different for every side. However, it is preferred that all the widths are of the same prescribed widths or that the prescribed width of the top and end circumferences is different from that of the left and right circumferences so as to give an image forming region 4 visually balanced. The setting of the printing region and non-printing region may be conducted not only by the setting of the positions of the cut lines 2 and 3 as described above, but also by processing image information to be printed.

The cutting-off portions 5 to 8 are then cut off along the cut lines 2 and 3 from the recording medium 1 printed. The cutting off can be easily conducted by hands. The recording medium is bent several times along the cut line 2 for example, whereby the cutting-off portion 5 can be cut off with extreme ease. Preferably, the recording medium is bent once toward the surface opposite to a printed surface, whereby the cutting-off portion can be finely separated from the printed region with extreme ease.

FIG. 3 typically illustrates a print obtained in accordance with such a means as described above. As illustrated in FIG. 3, the print 4 from which the cutting-off portions 5 to 8 have been cut off has a good appearance free of any non-printed region and is extremely similar to a silver salt photograph. Therefore, a highly value-added print is provided.

The recording medium according to the present invention may have a gloss layer and/or an ink-receiving layer generally provided on recording media. According to a preferred embodiment of the present invention, a recording medium has a gloss layer and/or an ink-receiving layer on one side of a base material, and the cut lines 2 and 3 thereof are a series of perforations in the form of a dotted line. More preferably, a coated resin layer is provided on the surface opposite to the gloss layer and/or the ink-receiving layer from the viewpoint of providing a highly value-added print having a touch and quality extremely similar to a silver salt photograph.

A resin material used in the coated resin layers is preferably a thermoplastic resin such as a polyolefin resin, polycarbonate resin, polyester resin or polyamide resin, with the polyolefin resin being particularly preferred from the viewpoint of melt extrusion coating. The coating may be conducted with an electron-radiation curing resin. A polyolefin resin preferably used is a homopolymer such as polyethylene, polypropylene, polybutene and polypentene, a copolymer of at least two α-olefins, such as an ethylene-butylene copolymer, or a mixture thereof. The polyethylene resin is particularly preferred from the viewpoints of melt extrusion coating and adhesion to a base material. As for the polyethylene resin, may be favorably used low density polyethylene, medium density polyethylene, high density polyethylene, linear low density polyethylene, a copolymer of ethylene with an α-olefin such as propylene or butylene, carboxy-modified polyethylene, or a mixture thereof.

In the present invention, the coated resin layer is formed by the so-called melt extrusion coating in which a polyolefin resin melted by heating is cast on a running base paper web, or by emulsion coating in which an emulsion of a polyolefin resin is coated thereon. In the extrusion coating, it is preferred that the base paper web be subjected to an activating treatment such as corona discharge treatment or flame treatment before the resin is applied onto the base paper web, in order to improve the adhesion between the resin and the base paper web. In the emulsion coating, it is preferred that calendering be conducted after coating to smooth the coated surface. While no particular limitation is imposed on the thickness of the coated resin layer in the present invention, a thickness of 5 to 50 μm is generally proper.

Since there is a possibility, when the cut lines are formed in the recording medium, that the components forming the gloss layer and/or the ink-receiving layer may fall off as powder to stain the recording medium and the interior of a printer, the formation of the cut lines is preferably performed from the surface opposite to the gloss layer and/or the ink-receiving layer. When the recording medium according to the present invention has a gloss layer and/or an ink-receiving layer on both surfaces of a base material, the formation of the cut lines 2 and 3 is preferably performed from a side with which paper dust from the gloss layer and/or the ink-receiving layer is less.

For another preferred embodiment of the present invention, the recording medium can be provided in the form of a label. More specifically, an adhesive layer is laminated on the surface of a base material, which is opposite to a printing surface followed by laminating a release paper thereon to form a label. After printing on the recording medium, portions easily separable by the cut lines are cut off, and the release paper is removed, whereby the resultant print can be stuck on an optional surface. Incidentally, it goes without saying that the adhesive layer and the release paper do not interfere with the function of the cut lines. For example, proper cut lines may also be provided in the adhesive layer and the release paper in accordance with the cut lines of the recording medium.

The present invention will hereinafter be described more specifically by the following Examples and Comparative Examples. However, the present invention is not limited to these examples.

[Preparation of Recording Medium]

A commercially available recording medium (trade name: GP-301, sales maker: Canon Sales Co., Inc.) was cut into a size of 150 mm width and 200 mm length, and then the cut sheet was subjected to a perforating treatment from the surface opposite to a gloss surface as illustrated in FIG. 1 to form half-cut lines. The MD direction was adjusted so as to be parallel to a shorter side. The teeth of a micro-sewing machine used in the perforating treatment were as follows. Incidentally, the cut portions in the half-cut lines were holes (through-holes) extending through the whole thickness of the recording medium.

EXAMPLE 1

A series of perforations parallel to the MD direction: cut portion (α)/uncut portion (β)=0.35 mm/0.23 mm, and A series of perforations perpendicular to the MD direction: cut portion (α')/uncut portion (β')=0.30 mm/0.20 mm.

EXAMPLE 2

A series of perforations parallel to the MD direction: cut portion (α)/uncut portion (β)=0.34 mm/0.21 mm, and A series of perforations perpendicular to the MD direction: cut portion (α')/uncut portion (β')=0.24 mm/0.18 mm.

EXAMPLE 3

A series of perforations parallel to the MD direction: cut portion (α)/uncut portion (β)=0.42 mm/0.25 mm, and A series of perforations perpendicular to the MD direction: cut portion (α')/uncut portion (β')=0.26 mm/0.19 mm.

COMPARATIVE EXAMPLE 1

A series of perforations parallel to the MD direction: cut portion (α)/uncut portion (β)=0.35 mm/0.23 mm, and A series of perforations perpendicular to the MD direction: cut portion (α')/uncut portion (β')=0.35 mm/0.23 mm.

COMPARATIVE EXAMPLE 2

A series of perforations parallel to the MD direction: cut portion (α)/uncut portion (β)=0.30 mm/0.20 mm, and A series of perforations perpendicular to the MD direction: cut portion (α')/uncut portion (β')=0.35 mm/0.23 mm.

COMPARATIVE EXAMPLE 3

A series of perforations parallel to the MD direction: cut portion (α)/uncut portion (β)=0.20 mm/0.15 mm, and A series of perforations perpendicular to the MD direction: cut portion (α')/uncut portion (β')=0.30 mm/0.20 mm.

COMPARATIVE EXAMPLE 4

A series of perforations parallel to the MD direction: cut portion (α)/uncut portion (β)=0.35 mm/0.23 mm, and A series of perforations perpendicular to the MD direction: cut portion (α')/uncut portion (β')=0.50 mm/0.30 mm.

[Evaluation Standard]

A printer (BJC-430J, trade name; sales maker: Canon Sales Co., Inc.) was used in printing to conduct printing with a black ink of 100% duty.

1. Ease of Separation:

The series of perforations parallel to the MD direction and the series of perforations perpendicular to the MD direction were subjected to the following test.

Each recording medium sample was bent once toward the surface opposite to a printed surface to rank the sample as A where separation could be achieved along the series of perforations with ease even at a printed portion, B where separation could not be achieved with ease at a printed portion, but easily achieved at a non-printed portion, or C where separation could not be achieved with ease at both printed portion and non-printed portion.

2. Fineness of Separated Portions:

After separating each recording medium sample along a series of perforation at a printed portion, the separated portion was observed at a visual distance of 25 cm to rank the sample as A where burrs and fuzzes were inconspicuous at the separated portion, C where falling off was observed at a part of the gloss surface, or B where it was in-between.

3. Conveyability:

Each recording medium sample was ranked as A where feeding was conducted without any particular problems upon printing, wherein the recording medium sample did not caused paper jam or the like, B where the portions of series of perforations were weak to cause the bending of the series of perforations, and so the recording medium was hard to set in an auto sheet feeder or to feed, or C where the series of perforations was broken upon its feeding, or paper jam occurred during its conveyance.

| | Ease of separation | | Fineness of separated portion | | Convey-ability | |
|---|---|---|---|---|---|---|
| | MD | CD | MD | CD | MD | CD |
| Example 1 | A | A | A | A | A | A |
| Example 2 | A | A | A | A | A | A |
| Example 3 | A | A | A | A | A | A |
| Comparative Example 1 | A | C | A | C | A | A |
| Comparative Example 2 | A | B | A | B | B | A |
| Comparative Example 3 | A | A | A | A | C | A |
| Comparative Example 4 | A | C | A | C | A | A |

As described above, according to the present invention, there can be provided recording media which can achieve stable conveyability without causing a failure in conveying such as bending of a series of perforations which form a half-cut line to separate the recording medium into two or more pieces, and breaking of the perforations during conveyance of the recording medium in a printer.

What is claimed is:

1. A recording medium for ink-jet recording, comprising at least one half-cut line formed in a first direction, which is a machine direction, and at least one half-cut line formed in a second direction, perpendicular to the machine direction, wherein the half-cut lines are in the form of a series of perforations with a cut portion and an uncut portion alternately arranged continuously, with the uncut portion lying between two cut portions, and the length of the uncut portion of the half-cut line in the first direction is longer than the length of the uncut portion of the half-cut line in the second direction, wherein the ratio of the length of the cut portion to the length of the uncut portion is within the range of from 1.3 to 1.7, and wherein the length of the uncut portion is within the range of from 0.18 mm to 0.25 mm.

2. The recording medium according to claim 1, wherein the depth of the cut portion in the half-cut lines is a depth extending through the whole thickness of the recording medium.

3. The recording medium according to claim 1, wherein the depth of the cut portion in the half-cut lines is a depth not extending through the whole thickness of the recording medium.

4. The recording medium according to claim 1, further comprising one or both of a gloss layer and an ink-receiving layer on one surface of a base material.

5. The recording medium according to claim 4, further comprising a coating resin layer on the surface opposite to one or both of the gloss layer and the ink-receiving layer.

* * * * *

UNITED STATES PATENT AND TRADEMARK OFFICE

CERTIFICATE OF CORRECTION

PATENT NO. : 6,716,492 B1
DATED : April 6, 2004
INVENTOR(S) : Kenichi Moriya et al.

It is certified that error appears in the above-identified patent and that said Letters Patent is hereby corrected as shown below:

Column 1,
Line 11, “widely spread” should read -- in widespread use --.
Line 18, “and” should read -- and are --.
Line 22, “the-widths” should read -- the widths --.
Line 36, “unusual” should read -- unusually --.
Line 43, “region” should read -- regions --.
Line 47, “problems” should read -- problem --.
Line 55, “a failure” should read -- failures --.

Column 2,
Line 58, “a” should read -- an --.

Column 3,
Lines 12, 50 and 60, “(mark” should read -- (marks --.

Column 4,
Line 8, “sizes” should read -- size --.
Line 29, “visually balanced.” should read -- visual balance. --.

Column 6,
Line 65, “perforation” should read -- perforations --.

Column 7,
Line 7, “caused” should read -- cause --.

Signed and Sealed this

Tenth Day of August, 2004

JON W. DUDAS
*Acting Director of the United States Patent and Trademark Office*